US007646299B2

(12) United States Patent
Krill

(10) Patent No.: US 7,646,299 B2
(45) **Date of Patent: *Jan. 12, 2010**

(54) ANTI-TAMPERING SECURITY MATERIAL

(75) Inventor: Jerry A. Krill, Fulton, MD (US)

(73) Assignee: The John Hopkins University, Baltimore, MD (US)

( * ) Notice: Subject to any disclaimer, the term of this patent is extended or adjusted under 35 U.S.C. 154(b) by 70 days.

This patent is subject to a terminal disclaimer.

(21) Appl. No.: 12/060,603

(22) Filed: Apr. 1, 2008

(65) Prior Publication Data

US 2009/0140857 A1 Jun. 4, 2009

Related U.S. Application Data

(63) Continuation-in-part of application No. 11/169,206, filed on Jun. 28, 2005, now Pat. No. 7,352,284.

(60) Provisional application No. 60/940,486, filed on May 29, 2007, provisional application No. 60/583,335, filed on Jun. 28, 2004.

(51) Int. Cl.
*G08B 13/08* (2006.01)

(52) U.S. Cl. ..... 340/545.1; 340/545.3; 340/545.6; 340/545.8; 340/540; 340/541; 340/568.2

(58) Field of Classification Search ..... 340/545.1, 340/545.3, 545.6, 545.8, 540, 541, 539.1, 340/539.13, 550, 551, 552, 568.2; 307/147; 109/24

See application file for complete search history.

(56) References Cited

U.S. PATENT DOCUMENTS

| | | | | |
|---|---|---|---|---|
| 4,843,375 | A | 6/1989 | Riordan | |
| 5,610,582 | A * | 3/1997 | Zahn et al. | 340/550 |
| 5,677,674 | A | 10/1997 | Wolf | |
| 6,215,397 | B1 | 4/2001 | Lindskog | |
| 6,244,081 | B1 | 6/2001 | Schlipper | |
| 6,400,268 | B1 | 6/2002 | Lindskog | |
| 6,686,539 | B2 | 2/2004 | Farquhar et al. | |
| 6,881,689 | B2 | 4/2005 | Cohee | |
| 7,064,667 | B2 | 6/2006 | Sosna | |
| 7,174,277 | B2 | 2/2007 | Vock et al. | |
| 7,482,924 | B1 * | 1/2009 | Beinhocker | 340/555 |
| 2002/0084090 | A1 | 7/2002 | Farquhar et al. | |
| 2004/0066302 | A1 | 4/2004 | Menard et al. | |
| 2004/0195001 | A1 | 10/2004 | Farquhar et al. | |
| 2005/0275537 | A1 | 12/2005 | Kerr et al. | |
| 2006/0164239 | A1 | 7/2006 | Loda | |

* cited by examiner

*Primary Examiner*—Hung T. Nguyen
(74) *Attorney, Agent, or Firm*—Francis A. Cooch

(57) ABSTRACT

Security material such as cloth, either normal strength or armored, or fragile webbing into which electronic micro-devices are woven to detect and react to tampering of the monitored article at the scene or via a network. Also disclosed are the use of fuses connected in the cloth or webbing to further monitoring tampering and multi-layered cloth for use as circuit boards and sensors. Facilitates the monitoring of high value articles and facilities and automatically records or responds to tampering attempts to increase the level of security for personal and organizational uses.

5 Claims, 12 Drawing Sheets

ANTI-TAMPERING SECURITY MATERIAL

CROSS-REFERENCE TO RELATED APPLICATIONS

This application is a continuation-in-part of U.S. patent application Ser. No. 11/169,206, filed Jun. 28, 2005, issued as U.S. Pat. No. 7,352,284 on Apr. 1, 2008, which claims the benefit of U.S. Provisional Applications 60/940,486, filed May 29, 2007, and 60/583,335, filed Jun. 28, 2004, the entire contents of which are both hereby incorporated by reference as if fully set forth herein, under 35 U.S.C. §119(e).

BACKGROUND OF THE INVENTION

1. Field of the Invention

The present invention relates to security material for use in detecting and preventing tampering with high value articles and facilities.

2. Background

There is an increasing concern about detection and prevention of tampering with such articles as computers, sensors, special materials, equipment cabinets, vehicles, and with facility entrances. Existing measures include anti-tamper circuits, locks, seals, and closed circuit monitoring. However, the first several of these can be countered and the third requires human involvement.

SUMMARY OF THE INVENTION

The invention is a material such as cloth or webbing with wired and wireless electronic circuits, accelerometers, fuses and batteries woven into the article to be protected or monitored that provides a form of "feeling" and can respond in a number of ways including wireless alertment. The security cloth can be woven with reinforced fiber material to provide enhanced resistance to tampering. The webbing can be ephemeral, so that its presence cannot be detected by an intruder. The interwoven circuits detect attempts to break through the security cloth or webbing and can relay an alert, counter the intrusion attempt, or just record the tampering event for future download. Also disclosed is material comprising multiple layers of cloth wherein the layers can be used, for example, for protection or as circuit boards or sensors. The security cloth/webbing of the invention is more foolproof, and in general lighter and more convenient, than the prior art and does not require human involvement once activated.

BRIEF DESCRIPTION OF THE DRAWINGS

Various embodiments are described below with reference to the drawings.

DETAILED DESCRIPTION OF THE PREFERRED EMBODIMENT(S)

Figure 1:
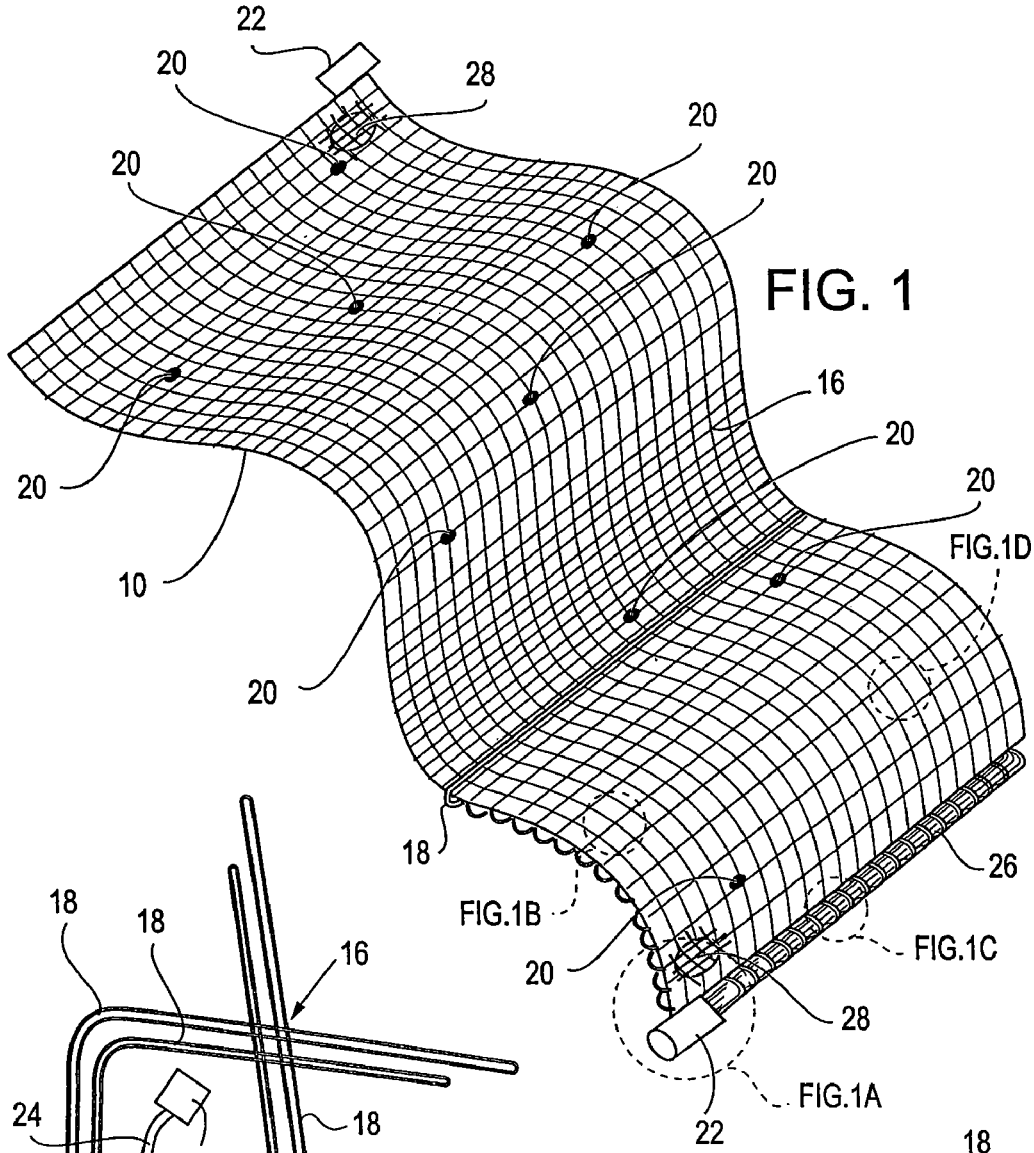
FIG. 1, consisting of FIGS. 1, 1A, 1B, 1C, and 1D, illustrates, respectively, the security cloth embodiment of the invention; four circuit loops and an accelerometer chip connected to an integrated circuit; conducting wire wrapped with reinforcing fiber; the end of a loop circuit in the cloth lining; and conducting wire as every n-th thread in the weave of the security cloth FIG. 2, consisting of FIGS. 2A, 2B, 2C, 2D, 2E, and 2F illustrates examples of how the security cloth embodiment of FIG. 1 can be attached to the article being protected including doors (FIG. 2A), safes and equipment storage drawers (FIG. 2B); padlocks (FIG. 2C); shipping containers (FIG. 2D); and laptop computers (FIGS. 2E and 2F).

FIG. 1 illustrates the security cloth 10 embodiment of the invention. It should be noted that the weave as shown in FIG. 1 is loose, in part, to permit better visualization of the invention. The invention can include such a loose weave giving the appearance of screen, netting, or gauze, or the weave can be much tighter such as any cloth with a high thread count.

Figure 1A:
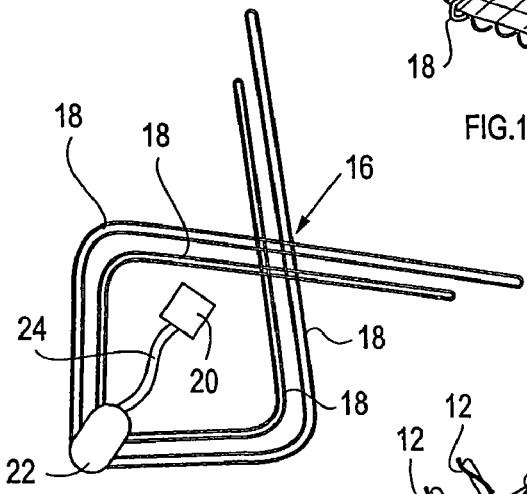
Figure 1B:
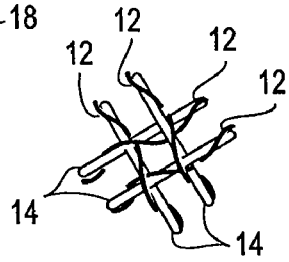
Figure 1C:
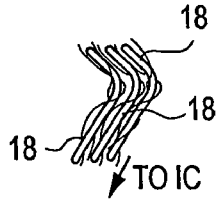
Figure 1D:
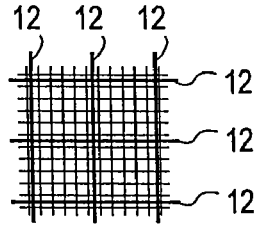

Some or all of the threads of the cloth are fine, coated conducting wires 12 (FIG. 1B) that are, as an option, wound around (based on relative stiffness) reinforcing fiber 14 (FIG. 1B) such as Kevlar® which permits the security cloth to act not only as a tamper alert but as armor as well. Either every thread is a conducting wire, perhaps wound around Kevlar® or other fiber, or only every n-th thread is a conducting wire (as shown in FIG. 1D). In addition to having the conducting wire wound around reinforcing fiber, the conducting wire and cloth can be "spun" together as single thread. FIG. 1D illustrates where the wire and cloth threads are considered as separate threads as they are interwoven, much like different colored cloth in apparel. The reinforcing fiber can also be a separate thread in the weave. As shown in FIG. 1A, the conducting wires are part of the weave 16 (FIGS. 1 and 1A) forming the cloth and forming circuit loops 18 (FIGS. 1 and 1A).

Embedded in the cloth (woven or glued in) are tiny accelerometer chips 20 (FIGS. 1 and 1A) that are electrically connected to the wire in both directions of the weave 16 for redundancy. The chips and all the conducting threads are electrically connected to one or more integrated circuits (ICs) 22 (FIGS. 1 and 1A) that monitor not only the tiny electrical current and/or voltage on each thread but also monitor the accelerometer chip readings (see 24 in FIG. 1A for lead from accelerometer chip to IC). The cloth lining 26 can be used to collect the conducting wire circuit loops which then, as previously noted, connect to an IC. FIG. 1C shows this in more detail.

A tampering attempt is detected by the integrated circuit that recognizes when a prescribed number of circuit "threads" have been cut and/or recognizes cutting, sawing, or chopping motion via the accelerometers embedded in the cloth and connected to the integrated circuit by some number of insulated conducting wires. However, there can be disadvantages with use of the accelerometers: 1) their modest cost prevents development of very low cost, expendable security cloth; and 2) their relatively large size restricts the minimum size, weight, and/or flexibility of the cloth that might otherwise be achieved.

Figure 9:
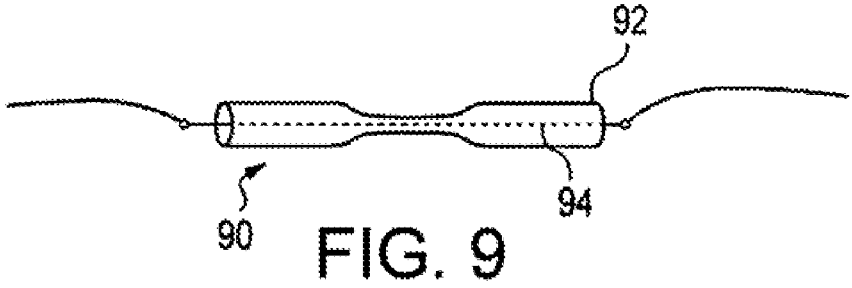
FIG. 9 illustrates a first embodiment of the fuse of the invention.
Figure 10:
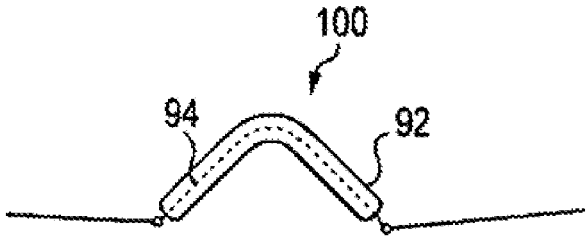
FIG. 10 illustrates a second embodiment of the fuse of the invention.

FIGS. 9-11 illustrate embodiments of the invention using electromechanical fuses that are substituted for embedded accelerometers. The fuses are very inexpensive and could also be used to recognize intrusion accelerations indicative of cutting, sawing, or chopping. By making a small (for example, ⅛"-¼" in length) fuse different shapes and with different ceramic materials the fuse can be made susceptible to breakage when certain types of motions are applied. Further, if fine conducting wires are embedded in the fuse and attached in series to the conducting, insulated security cloth threads, breakage of the fuse and its embedded wires will be detected as a loss of voltage (or current) by the integrated circuit.

FIG. 9 illustrates a simple example of a fuse 90 comprising a breakable shell 92 and a thin conducting wire filament 94, of a shape to favor breakage from a sharp orthogonal blow (a chop). Made of brittle ceramic material, the diameter of the narrower portion is selected to break (and also break the embedded wire filaments) from a prescribed chop force. If such a blow breaks the fuse, and, if the embedded filaments have been electronically attached to an integrated circuit that records loss of voltage (or current) in any circuit with which it is connected, the recognized loss of voltage (current) will be indicative of the g forces of the chopping blow that shattered the fuse.

FIG. 10 illustrates another fuse 100 also comprising a breakable shell 92 and a thin conducting wire filament 94. This fuse's shape, however, is susceptible to significant pulling as might occur with attempted cutting or sawing. The fuse's angle of bending and diameter could be tailored to ensure breakage at a specified force parallel to the axis of the fuse.

Figure 11A:
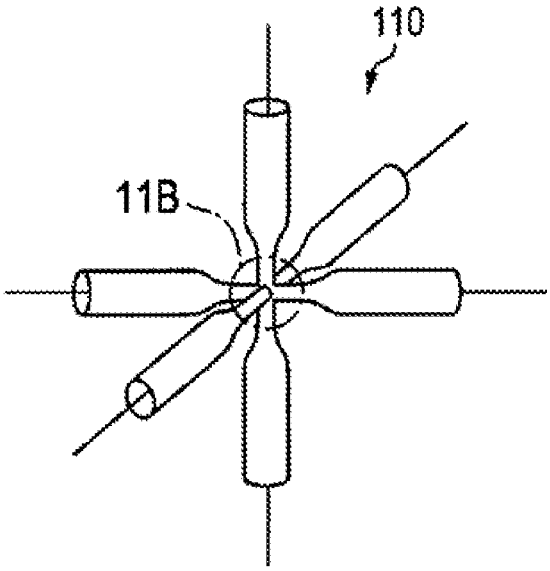
FIG. 11, consisting of FIGS. 11A and 11B, illustrates a third or multiple fuse embodiment of the invention (FIG. 11A) and a detailed view of the junction of the multiple fuses (FIG. 11B).
Figure 11B:
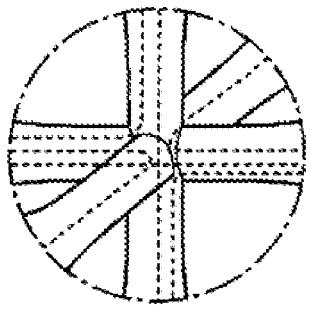
Figure 12A:
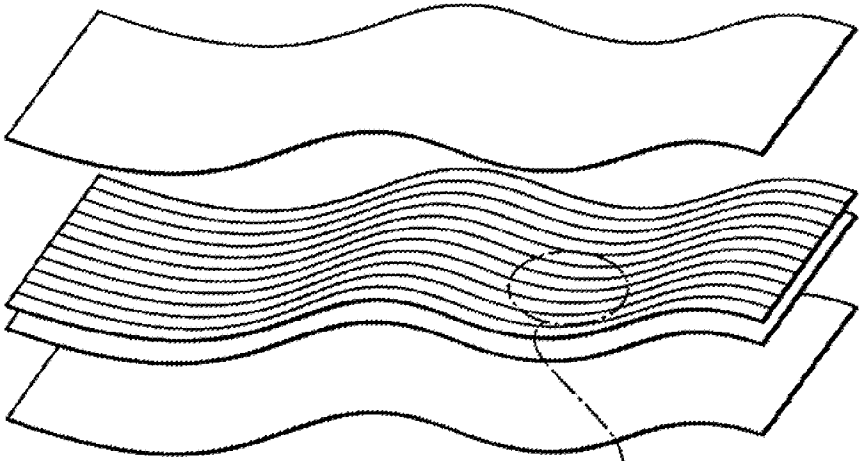
FIG. 12 illustrates an alternative, multi-layered embodiment of the security cloth of FIG. 1.
Figure 12C:
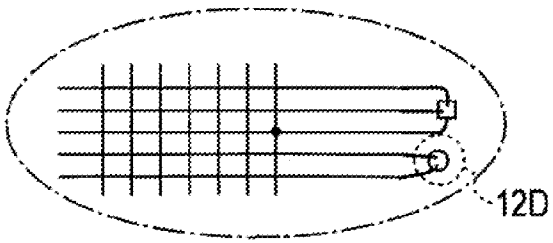
Figure 12D:
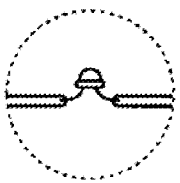
Figure 12B:
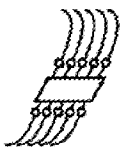

FIGS. 11A and 11B illustrate, respectively, a configuration of orthogonal fuses 110 and the detail where the fuses are joined which is a combination sensitive to both chopping and cutting/sawing motions. Although the use of ceramic has been considered above, other materials of sufficient brittleness and practical sizes for the intended g force breakage, such as glass or certain plastics, could be used.

One or more batteries 28 (FIG. 1) are woven into the fabric and are thereby protected by the fabric itself from tampering. An option is for direct power connection of the security cloth, but even in this case at least one backup battery would be woven in. The security cloth is expected to have very low power consumption except possibly when it is giving an alarm. Therefore, rechargeable batteries and backup batteries would sometimes be plugged into a charger connected to line power.

The security cloth 10, which can be camouflaged, or even made to appear decorative for esthetic or deceptive reasons, depending on the use, is attached to an article to be protected as illustrated in FIG. 2, for example, an opening (e.g., door (FIG. 2A), safe, or equipment storage drawer (FIG. 2B)). In one embodiment the cloth forms a bag that can envelop the protected article (e.g., a laptop computer, FIG. 2E wherein the invention is anchored into, e.g., a wall) or is placed around the protected article, for example, adhesive security cloth attached together via their sticky backsides (e.g., a padlock, FIG. 2C, although placing the padlock in a bag may also be practical).

Figure 2A:
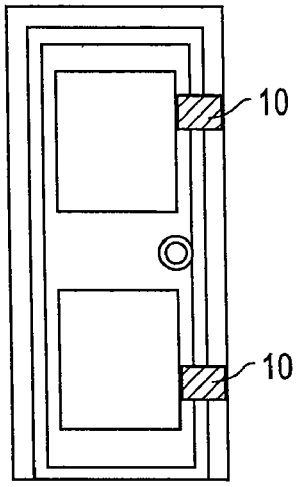
Figure 2B:
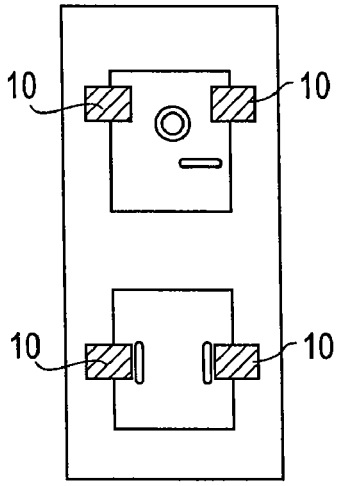
Figure 2C:
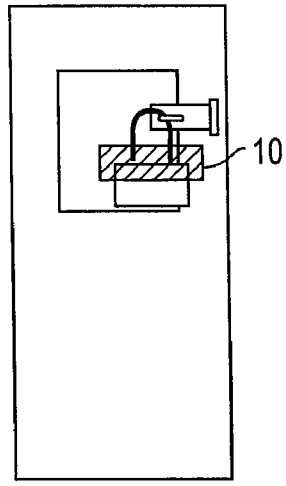
Figure 2D:
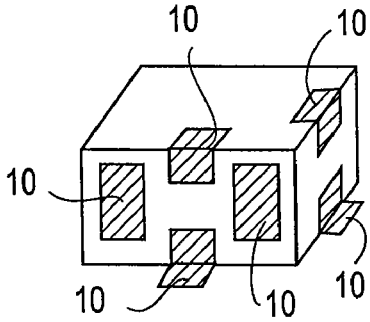
Figure 2E:
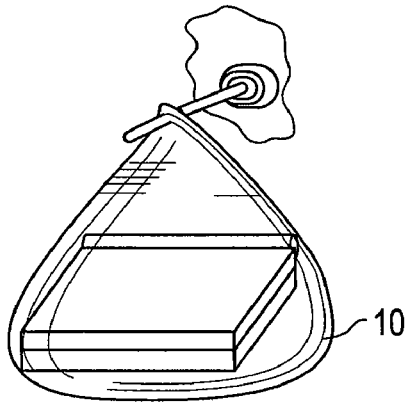
Figure 2F:
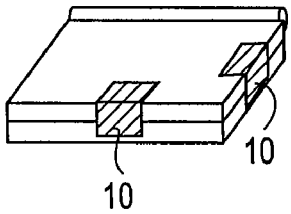

In another embodiment the cloth is strongly glued onto or woven into or otherwise attached to the article to be protected, such as a door, equipment storage drawer or computer cover (FIGS. 2A, 2B and 2F) or shipping container (FIG. 2D). Although not shown, the security cloth could be woven into clothing or designed into clothing itself as a means to protect people from violence or abduction.

In the case of the shipping container, not only can the security cloth of the invention be used on the container lid or other opening, but the security cloth could be applied in large patches to the sides of the container to monitor penetration of the sides and/or the cloth could attach the container to the surface on which it rests to ensure the container remains in place. For the webbing, as discussed below, a weak adhesive may be sufficient to attach the webbing, so that tampering will detach or otherwise disrupt the webbing but, in any event, the webbing can be substituted for the security cloth in the above examples. In this manner the ethereal webbing could be a "tripwire" in contrast to the deterrent, armored role of the cloth.

If there is an attempt to break or cut the security cloth, the accelerometers detect accelerations or the fuses are broken and the acceleration or fuse data is sent to the ICs for possible reaction. Also, the ICs monitor each of the conducting threads of the security cloth and determine if some pre-set number of circuits are broken. The ICs contain logic with criteria to conclude that tampering is occurring and to activate one or more pre-programmed alerts/responses.

For example, the determination that a tamper event is occurring is made by any such IC if one or more of the following occurs:

- n rows and m columns of wire circuits no longer carry current or a set voltage;
- p accelerometers indicate:
  - a. >15 g impulses (implying blows); or
  - b. >3 g extended activity (implying sawing or cutting); and/or
- a certain number of fuses are broken and, depending on the type used, indicate either chopping or sawing/cutting or both.
- line power cut to ICs (but each has their own battery backup).
- Note: number of g's is for example only—any setting could be used.

If tampering is determined by the occurrence of one or more of the above-detected conditions, the following example response/alert options can be activated:

silent wireless alert;

audio/visual alarm;

ignition or other power to the article being protected disabled; or activation of silent audio/visual recording of the tampering event.

For the case of wireless activation, the ICs would have very low power transmitters to a nearby cellular, wireless, or wired transmitter relay. For example, a new class of small autonomous node transmitters known as "motes" may be appropriate (see, for example, Sci. Am., June 2004 pp 85-91). If the article being protected is mobile, such as a vehicle or a container being transported, then the ICs may also be connected to GPS or inertial navigation (INS) circuits to allow reporting and update of location.

Figure 3:
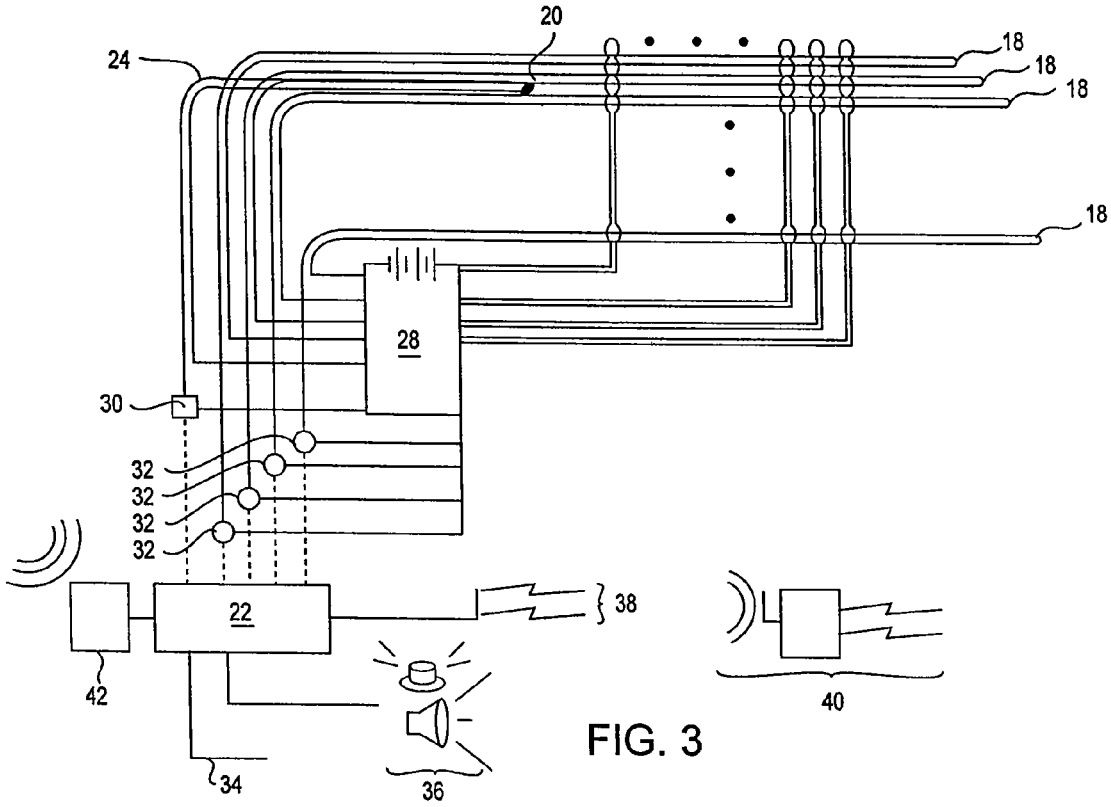
FIG. 3 illustrates the circuits and logic gates for the security cloth embodiment of FIG. 1.

FIG. 3 illustrates the circuits and logic gates for the security cloth of the invention. In addition to the circuit loops 18 formed by the interwoven coated conducting wires and the embedded accelerometer chips 20 (with electrical lead 24) or fuses 90, 100 or 110 and battery 28, the following can also be included: accelerometer signal monitor 30 for sending data to the IC with logic 22; and circuit monitor 32 for monitoring voltage and/or current and sending data to the IC with logic. Also shown in FIG. 3 are various response/alert options: line to a disablement (of the article's power) circuit 34; audio/visual alarm 36; low-power wireless alert and location signals 38; and a cellular wireless or line relay 40 to a network where audio and/or video recording of the tampering event can be initiated. Also shown is a GPS chip 42 for providing location data to the IC. The GPS component, as well as the IC with logic, could also be embedded in the fabric for protection and tamper monitoring.

FIG. 12 illustrates a simpler means of constructing the security cloth of the invention that, as a result, may reduce cost and allow for enhanced complexity. As shown, conducting gridlines may be placed on top of a cloth backing using inkjet, silk screen, etch, embroider, or paint rather than weave the conducting filaments as part of the cloth. Simple metallic patterns can be painted on with loop-backs to one or more convergence points on the cloth. At those points integrated circuits could be glued or sewn onto the backing and their metallic contact leads glued or micro-soldered to the "painted" lines of conducting material. The lines can be solutions of gold, silver, or copper, for example, with sufficient thickness to adhere to the cloth and tolerate flexing of the cloth.

The inset in FIG. 12 illustrates the metallic grid and connection to integrated circuit controllers as well as other sensors such as accelerometers and fuses as previously described. As also shown in FIG. 12, the electronic cloth can be sandwiched between other cloths to, e.g., protect it, conceal it, and/or connect it to the article to be protected. The layering is probably most simply attached by stitching, but glue bonding may also provide adequate flex and strength.

Figure 13A:
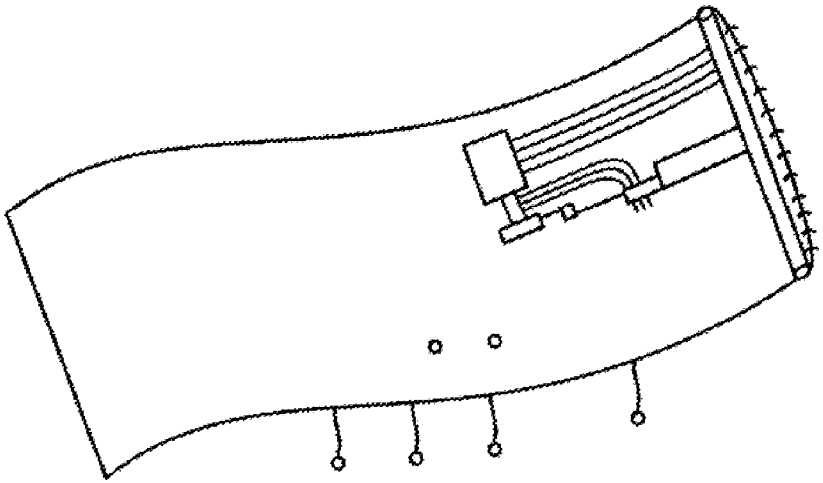
FIG. 13 illustrates an embodiment of the security cloth used as a flexible circuit board.
Figure 13B:
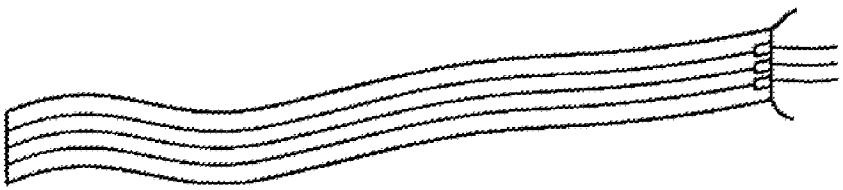

FIG. 13 illustrates a more general embodiment of security cloth in which the cloth as described above is used as a flexible circuit board. The advantage over a standard board would be its flexure providing the ability to conform to the moving human body or to be for more effectively packaged in a uniquely shaped container. For example, the board could be folded or curved to conform to the outsides of a variety of vehicles without having to design a differently shaped configuration for each type of vehicle.

Also, a number of such boards could be connected, e.g., via the claw connectors of FIG. 5, to a cloth backplane that interconnects a number of such boards or interconnects cloth boards to conventional stiff, flat boards. Multi-layer circuit boards could also be fabricated from multiple layers of the cloth boards with interconnecting conducting leads between them having sufficient spare length to accommodate flexure differences between the 'boards'.

As for the cloth described above, painted or inkjet circuit patterns would be placed onto the board, and standard or custom-shaped electronic components could be glued to the cloth and their conducting leads glued or soldered to the conducting gridlines. For components that also must connect to other components on other layers of the board, holes for bleed-through of the paint onto the other side of the cloth could then be connected to the conducting gridlines or components on cloth above or below the components.

Figure 14:
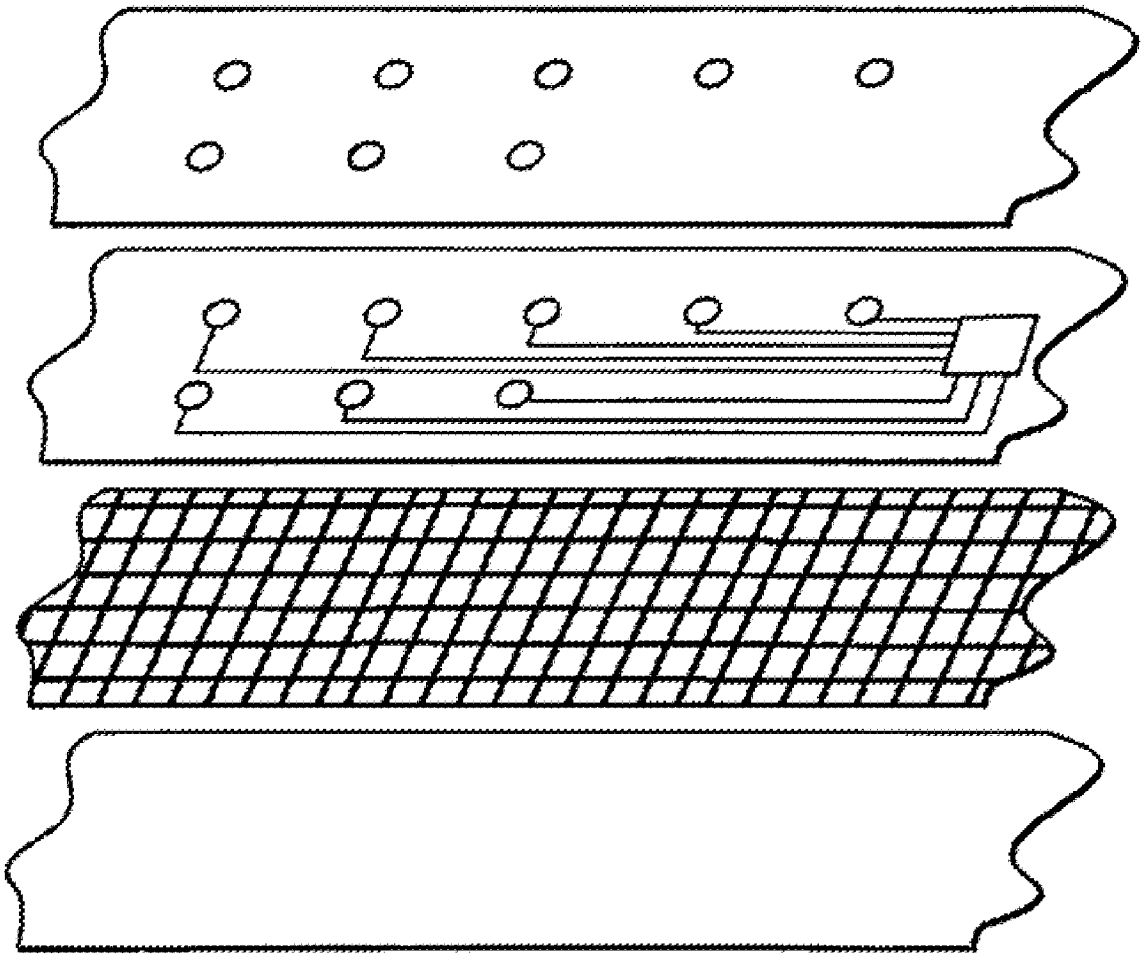
FIG. 14 illustrates a multi-function cloth that can accommodate functions in addition to security features and sensors described in other embodiments of the invention.

FIG. 14 illustrates a multi-function cloth that not only could accommodate the security features and sensors described herein for security cloth and webbing but could also accommodate other functions. In FIG. 14, the security cloth is shown as the layer second from bottom. Just above is a layer of sensor cloth. This layer is constructed in the same manner as the security cloth described herein, however, instead of accelerometers or fuses, a circuit monitoring components and multiple sensors of various types are mounted and electrically connected to a controller integrated circuit. The sensors can be for heat, pressure, specific chemicals, biological, nuclear, audio or video. Their data is stored and forwarded via the controller integrated circuit which also controls wired or wireless transmission of the data. The top layer is for concealment and protection of the sensor layer and could be security cloth or an armor fabric such as Kevlar®. The top layer may consist of holes or glass windows that are transparent to the sensors in the underlying layer. The multi-layer, multi-function cloth could be attached via one of the fastening means described herein or worn as clothing or a concealed layer.

In all the illustrations, multiple layers may require interlayer cushion material (see FIG. 14) that fills the space between discrete components and that functions for heat dissipation, e.g., containing small cooling tubes, as obscuration materials and that functions to reduce detection of circuitry, and/or to provide for personal comfort if worn.

Figure 4:
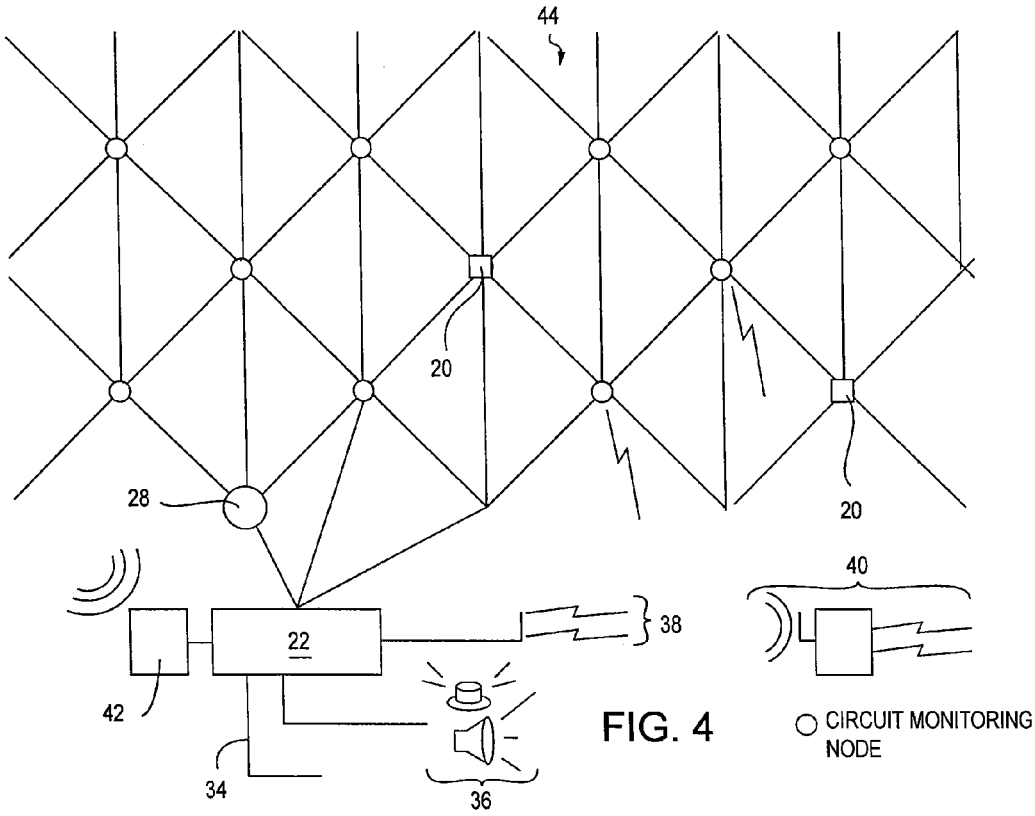
FIG. 4 illustrates the security webbing embodiment of the invention.

The security webbing is a variant of the security cloth embodiment described above. The security webbing embodiment 44 as shown in FIG. 4 provides more electrical interconnection for increased redundancy with the type of interconnecting (but conducting) threads with gauge selected depending on the required response. For example, the threads could be ultra-fine, coated, conducting filaments that can be easily broken, as a kind of trip-wire. When the circuits are broken, the ICs respond as identified above. This would appear similar to a spider web and the tampering can be reported with the tamperer unaware that the web is responding.

A stronger gauge of conducting, insulated wire thread of the security webbing embodiment has strong connecting wires that are not as easily broken and are harder to counter or deactivate because of the massively interconnected chips, analogous to neurological networks.

As shown in FIG. 4, accelerometer chips 20 and a battery 28 are embedded in the webbing as well as circuit monitoring nodes which are embedded in the webbing rather than being integrated into the logic IC 22 for the cloth. As with the security cloth, fuses can be substituted for accelerometers in the webbing as well. They are connected to the logic IC via a coded network protocol for reporting over the interconnected wires. An alternative is for each monitor node to possess a tiny ultra-low power wireless transmitter to transmit tamper events to the logic IC. As with the security cloth embodiment, FIGS. 2A-2F illustrate example applications for the webbing as well.

Once the logic IC receives data from the accelerometers and the monitor nodes and determines that tampering is occurring, the logic IC can initiate various pre-programmed responses/alerts similar to the security cloth alerts using the following: disablement (line to disablement circuit 34); audio/visual alarm 36; low-power wireless alert and location signals 38; and a cellular wireless or line relay 40 to a network where audio and/or video recording of the tampering event can be initiated. As with the security cloth, also shown is a GPS chip 42 for providing location data to the logic IC which alternatively could be embedded in the webbing.

The security cloth and webbing embodiments discussed above could be used one time and discarded if they are sufficiently inexpensive products. In this case glue with strength beyond that of the cloth and webbing may be sufficient as a fastener. Further, the cloth and webbing could come pre-programmed or easily programmed with pre-set or custom settings of tamper detection thresholds and alertment responses and user authentication code.

However, at least initially, the security cloth and webbing of the inventions are probably expensive enough to warrant reuse. Therefore, FIGS. 5A-5I and 6A-6E illustrate a new type of fastener to lock and unlock two security cloths of the invention that together guard an opening such as a doorway or drawer. FIGS. 7A-7D illustrate methods for attaching the security cloth to the articles to be protected. Finally, FIGS. 8A-8B illustrate how common fasteners can be modified for cloth opening and closing, whether multi-use or one time use products.

Figure 5A:
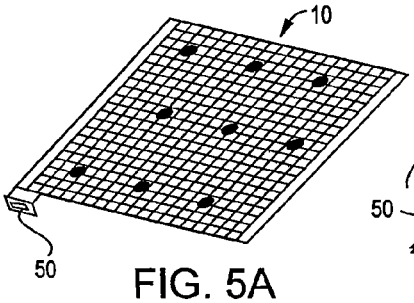
FIG. 5, consisting of FIGS. 5A, 5B, 5C, 5D, 5E, 5F, 5G, 5H, and 5I illustrates a claw-type fastener embodiment for the security cloth of FIG. 1 including, respectively, an example of the security cloth; security cloth with eyelets; the security cloth with the claw assembly; a biometric device and keypad for connection to the security cloth; a claw with pinhole; claw with notch in open position; claw with notch in closed position; claw with pinhole in closed position; and two swaths of security cloth joined by a claw assembly.
Figure 5C:
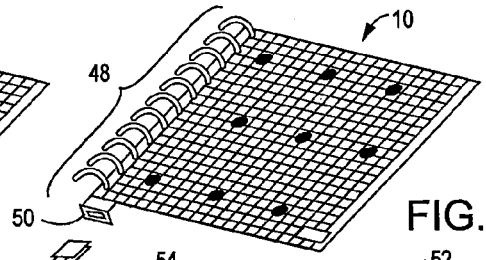
Figure 5D:
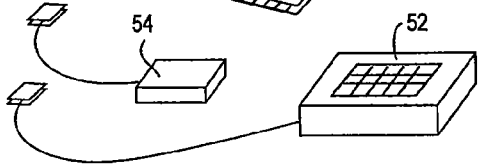

FIGS. 5A-5I illustrate a claw-type fastener embodiment (connector claw) for mechanically and electrically connecting the security cloth of the invention 10 to open or close in the same manner as a padlock. Either a swath of the security cloth (FIG. 5A) or a swath (all swaths shown with embedded accelerometers represented by the black dots) with eyelets 46 made of conducting material, e.g., brass, and with each eyelet electrically connected to a woven circuit (FIG. 5B) can be connected to another security cloth through the use of a connector claw assembly 48 (FIG. 5C). The security cloth is woven into the connector and electronically connected to the claws. The assembly consists of a number of "claws" all connected to an axle 49 (FIG. 5F) driven by a small electric motor (not shown) or small finger-operated crank (not shown).

Figure 5B:
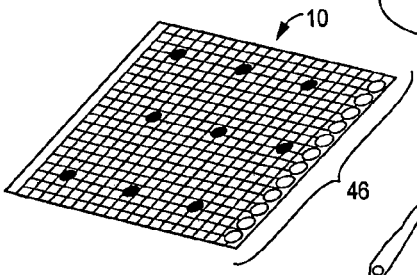
Figure 5E:
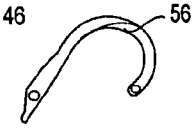
Figure 5F:
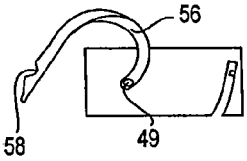
Figure 5H:
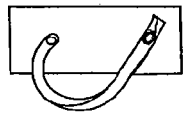
Figure 5G:
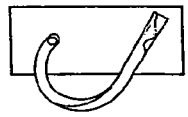
Figure 5I:
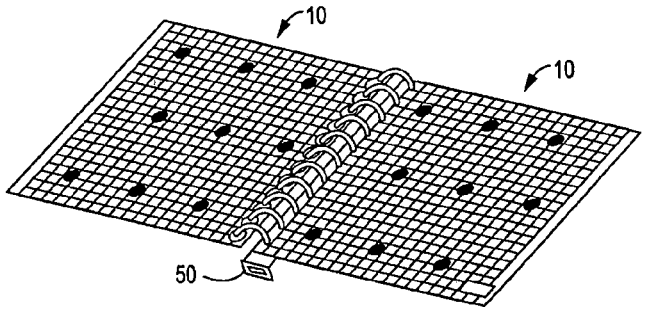

Upon activation, the claws close around the second piece of security cloth, either by penetrating through the weave of FIG. 5A or closing through the conducting loops of FIG. 5B as shown in FIG. 5I. With FIG. 5A the two cloths remain separate circuits that could each be activated separately. For the case shown in FIG. 5I, the conducting weaves are electrically interconnected through the conducting eyelets and via the claws to operate as a single security cloth. Using the connector claws, two security cloths can be bonded to the sides of a lid or door, for example, and connected or disconnected as the door/lid is locked and then opened, respectively.

The connector claw assembly can be of variable width (and corresponding variable number of claws) depending on the width of the security cloth. It is anticipated that the security cloth may come in different sizes in accordance with the sizes of the articles to be secured (like band aids). The security cloth may be custom programmed and a unique operator authentication code inserted via an interface, such as a USB port 50 (see FIGS. 5A and 5C), to which a computer or unique keypad 52 (FIG. 5D) can be connected. The keypad or computer using the interface provides selection of the alert criteria and options described above to be selected and the user password inserted. A biometric device 54 (FIG. 5D) could be connected as an option to allow registry of a thumbprint, for example, as a basis for opening and closing the fastener.

In the above examples it is assumed that the connector claws assembly contains, or is near, the logic IC where the tamper detection and alertment functions are performed. Thus, the USB connector is shown as part of the connector assembly in the figure. If the security cloth does not contain a connector claw assembly, the USB or other electronic interface port could be woven into the cloth (for protection) near the logic IC that it interfaces.

FIGS. 5E-5H also illustrate how the individual claws grab the second cloth and lock into place. In one embodiment (FIG. 5F), each claw 56 has a notch 58 that is engaged in the claw housing (FIG. 5G) when the motor has rotated the claws around the axle. This is analogous to the mechanical locking mechanism of a padlock, only much smaller. A locking mechanism (not shown) could also be added to prevent the notch from disengaging thereby locking the claw in place. The claw is also relatively sharp as a means to find its way between threads of the weave pattern of the security cloth it grabs. The other embodiment (FIG. 5E) is more sophisticated with each claw possessing a hole, in place of the notch, analogous to the eye of a needle. When the claw is rotated around, through the security cloth and into its locking slot (FIG. 5H), small pins on one or both sides of the eye are slid through the eye to secure the claw as shown, for example, in FIGS. 6B-6E.

Figure 6A:
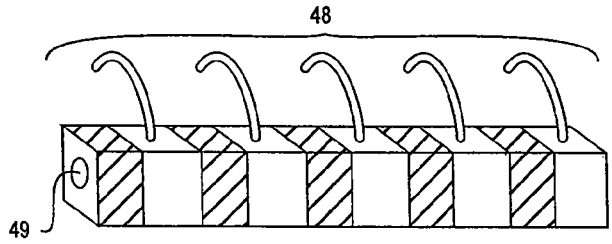
FIG. 6, consisting of FIGS. 6A, 6B, 6C, 6D, and 6E, illustrates an electro-active polymer (EAP) material or electromagnetic solenoid for use with the claw-type fastener embodiment of FIG. 5 including, respectively, a claw assembly; claw in closed position in locking slot using EAP with pins not inserted; claw in closed position in locking slot using EAP with pin inserted; electromagnetic solenoid and pin assembly in locking slot without claw; and claw in closed position in locking slot using an electromagnetic solenoid with pin inserted.
Figure 6B:
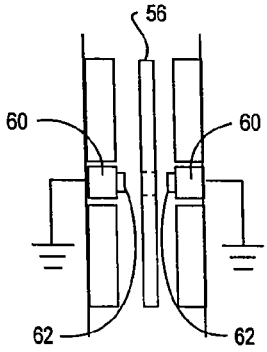
Figure 6C:
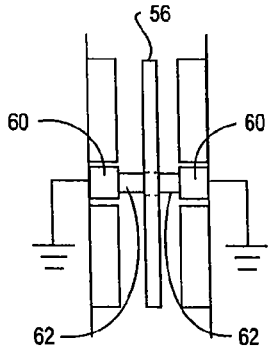
Figure 6D:
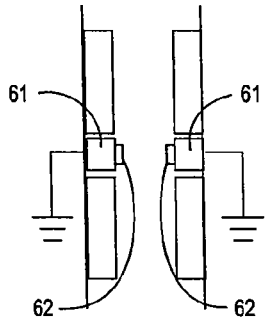
Figure 6E:
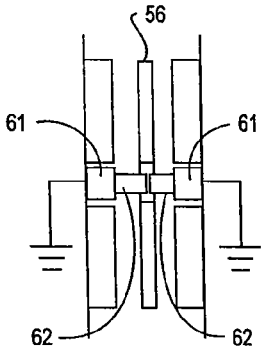

In the FIGS. 6B-6C, electro-active polymer (EAP) material activated piston 60 is used to insert the pins into the hole of the claw as discussed above. The EAP material is electrically activated by voltage in accordance with the disclosure contained in U.S. patent application Ser. Nos. 10/892,910, filed Jul. 16, 2004 and 10/892,908, filed Jul. 16, 2004, both of which are incorporated by reference herein in their entirety. In FIGS. 6D-6E an electromagnetic solenoid is used in place of the EAP activated piston where current is applied to activate the solenoid. FIGS. 6 A-6E illustrate the EAP and solenoid configuration in more detail.

FIG. 6A illustrates the connector claw assembly 48 connected to an axel 49 connected to a motor (not shown) or finger crank (not shown). When the motor or finger crank moves the claws to the closed position in their respective locking slots (FIG. 5H), pins can be inserted in a hole in the claw to secure it. FIG. 6D shows the empty locking slot for the claw with the pins 62 and the electromagnetic solenoid 61. In FIG. 6B, the claw 56 is in the locking slot but the pins have not yet been inserted. As discussed above, once the EAP activated piston 60 has been electrically activated by the application of a voltage, the EAP activated piston pushes the pins into the hole in the claw thereby locking the claw securely into place (FIG. 6C). The EAP pistons could be replaced by more conventional small electromagnet solenoids 61 as shown in FIGS. 6D and 6E or other types of activated plunger, but at a likely increase in weight and size.

Figure 7A:
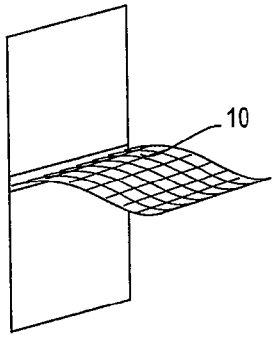
FIG. 7, consisting of FIGS. 7A, 7B, 7C, and 7D, illustrates various means for securing the security cloth or webbing of the invention to the article being monitored including, respectively, glue, weaving, claw assembly, and bag with anchor.
Figure 7C:
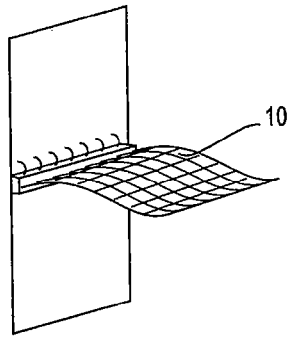
Figure 7B:
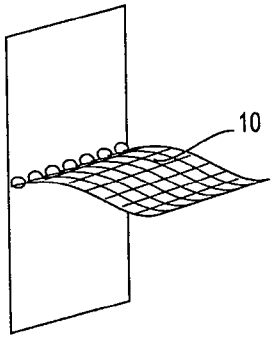

FIGS. 7A-7D illustrate various means for securing the security cloth or webbing of the invention to the article to be monitored. In FIG. 7A a strong glue, exceeding the strength of the cloth or webbing, bonds the security cloth to the article. FIG. 7B illustrates the security cloth 10 woven directly into the object to be secured. For example, a metal drawer could have a linear series of holes so that the weaving of the thread would encompass the edge of the drawer, through the holes, while the drawer and cloth were being manufactured. Not shown is security cloth that has an adhesive backing that is wrapped around the article or a portion thereof such that the adhesive backings are adhesively connected back to back.

FIG. 7C illustrates the use of the connector claw assembly itself used to embed the claws into the article if it consists of a soft material such as a wood or plastic door or drawer. Again, it is assumed that the claw would be a stronger connection to the article than the security cloth alone. In this way, an intruder would be more likely to disturb the cloth even if they tried to attack just the connector.

Figure 7D:
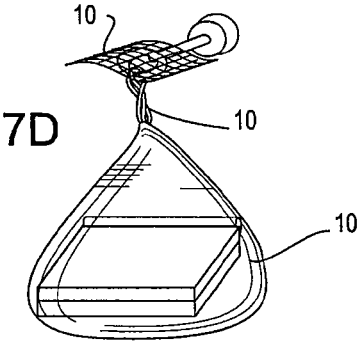
Figure 8A:
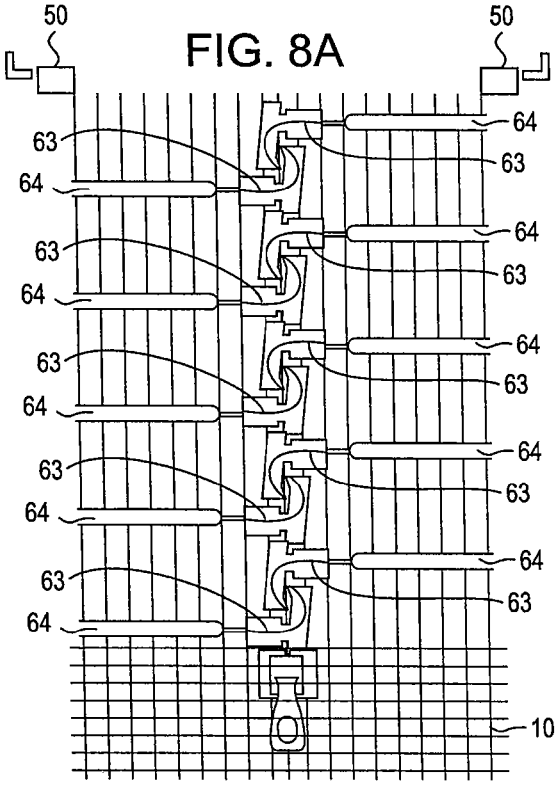
FIG. 8, consisting of FIGS. 8A and 8B, illustrates example modifications to normal fasteners, that is, respectively, zippers and buttons, for use with the security cloth of the invention.
Figure 8B:
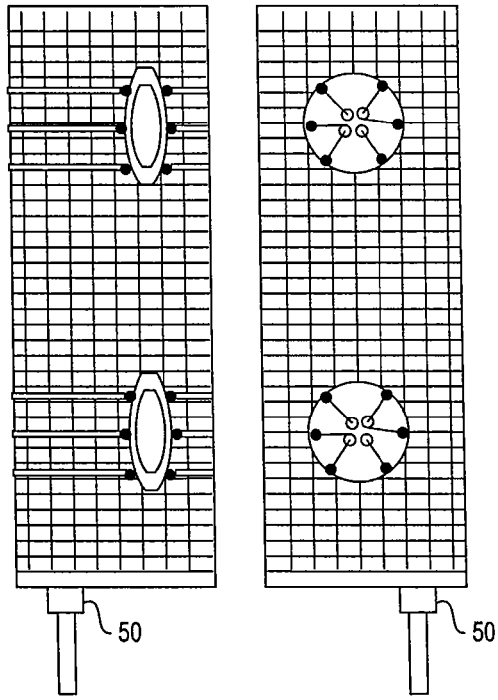

FIG. 7D is a cloth bag enveloping an article to be protected, such as jewelry. The top of the bag is just the cloth twisted into a rope and tied or woven onto a strong anchor to prevent the bag from being carried away. The anchor can, itself, be clothed in the cloth or webbing so that tampering with the anchor itself would cause an alert by the cloth.

FIGS. 8A-8B illustrate more conventional forms of fasteners that may be less secure than the claw embodiment described above but are, perhaps, less expensive to manufacture. FIG. 8A is a zipper, metal or nonmetal, with special conducting channels 63 to cross-connect the circuits 64 of the security cloths being zipped together. Of course, a standard zipper could be used but the circuits would necessarily remain separate circuits and the zipper would then require protection from unauthorized opening, e.g., via security cloth or webbing. Note that the illustration of connecting circuits shows parallel connections of circuits 64, rather than series connections, so that even unzipped, the separate circuits could continue to operate.

The security of the zipped security cloth would rely on the locking cover over the zipper "grip"—activated by a key code, combination, or USB port 50 connection to send the user password to the lock mechanism. The zipper grip could also be covered by a segment of security cloth 10 or webbing as shown in FIG. 8A. A simple alternative is to leave the zipper unlocked with the interconnected security cloth raising an alarm if unzipped, unless the user password was first entered via an interface.

FIG. 8B shows buttons with electrical contact points (indicated by the black dots) on their underside to enable parallel connection of separate security cloths. The buttons would engage the security cloth (assuming activation by user password via USB port 50 as described above which can also be used to program the logic ICs in the security cloth). If the buttons are unbuttoned, the broken circuits between the security cloths would cause an alarm, unless a user password is first entered through the USB port into the logic IC embedded in the cloth. The buttons could also be covered by sections of security cloth or webbing. The button contact points could be spring-loaded contacts or pins if necessary in order to ensure connectivity.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A security material for protecting an article from tampering comprising:

a cloth woven of a plurality of threads, one or more of the plurality of threads comprising a conducting wire, the conducting wire carrying an electrical current and/or voltage;

a plurality of fuses, each fuse comprising a breakable shell and a wire filament inside the breakable shell, the wire filament connected to the conducting wire; and an integrated circuit electrically connected to each of the two or more conducting wires for monitoring the conducting wires, the integrated circuit containing logic for determining whether tampering is occurring and activating one of a plurality of pre-programmed alerts;

wherein tampering with the article causes a break in one or more of the conducting wires and/or one or more of the plurality of fuses resulting in a loss of current and/or voltage therein and thereby causing the integrated circuit logic to activate at least one of the plurality of pre-programmed alerts.

2. The security material as recited in claim 1, wherein each of the plurality of fuses has a center portion of its breakable shell having a narrower diameter than the end portions of its breakable shell thereby permitting the narrower portion to break from a sharp orthogonal (chopping) tampering motion.

3. The security material as recited in claim 2, wherein the centers of the breakable shells of at least two of the plurality of fuses are connected orthogonally to form one fuse, the orthogonally connected fuses being susceptible to breaking from a multi-directional tampering motion.

4. The security material as recited in claim 1, wherein each of the plurality of fuses has its breakable shell bent at an angle thereby permitting the breakable shell to be susceptible to breaking from a cutting or sawing tampering motion.

5. The security material as recited in claim 1, wherein the breakable shell is selected from one of a ceramic, glass and plastic.

* * * * *